US008221103B2

(12) United States Patent
Peters et al.

(10) Patent No.: US 8,221,103 B2
(45) Date of Patent: Jul. 17, 2012

(54) FLUID MOTOR HAVING IMPROVED BRAKING EFFECT

(75) Inventors: Dieter Peters, Witten (DE); Peter Krebs, Witten (DE); Joachim Wiendahl, Dortmund (DE)

(73) Assignee: N & G Facility Management GmbH & Co. KB, Witten (DE)

( * ) Notice: Subject to any disclaimer, the term of this patent is extended or adjusted under 35 U.S.C. 154(b) by 332 days.

(21) Appl. No.: 12/520,438

(22) PCT Filed: Dec. 19, 2007

(86) PCT No.: PCT/EP2007/011186

§ 371 (c)(1),
(2), (4) Date: Jun. 19, 2009

(87) PCT Pub. No.: WO2008/077561

PCT Pub. Date: Jul. 3, 2008

(65) Prior Publication Data

US 2010/0178186 A1 Jul. 15, 2010

(30) Foreign Application Priority Data

Dec. 21, 2006 (DE) ..... 10 2006 061 854

(51) Int. Cl.

| | |
|---|---|
| ***F01C 13/00*** | (2006.01) |
| ***F03C 2/00*** | (2006.01) |
| ***F03C 4/00*** | (2006.01) |
| ***F04C 13/00*** | (2006.01) |
| ***F04C 2/00*** | (2006.01) |

(52) U.S. Cl. ..... 418/181; 418/259; 418/270; 188/170

(58) Field of Classification Search ..... 418/15, 418/181, 259, 270, 152, 153; 188/170, 17, 188/18 A See application file for complete search history.

(56) References Cited

U.S. PATENT DOCUMENTS

| | | | | |
|---|---|---|---|---|
| 2,927,669 | A | | 3/1960 | Walerowski |
| 3,125,200 | A | | 3/1964 | Kaman |
| 3,602,315 | A | * | 8/1971 | Tuttle ..... 418/1 |
| 4,434,974 | A | | 3/1984 | LaCount |
| 6,077,061 | A | | 6/2000 | Peters et al. |
| 6,413,062 | B1 | | 7/2002 | Peters |

FOREIGN PATENT DOCUMENTS

| | | |
|---|---|---|
| DE | 1102488 B | 3/1961 |
| EP | 1099040 | 5/2001 |
| WO | 9502762 | 7/1994 |
| WO | 9702406 | 1/1997 |
| WO | 0004276 | 1/2000 |
| WO | WO 0004276 | 1/2000 |

OTHER PUBLICATIONS

International Search Report dated, Apr. 2, 2008 in PCT/EP2007/011186, 4pgs.

* cited by examiner

*Primary Examiner* — Theresa Trieu
(74) *Attorney, Agent, or Firm* — Banner & Witcoff, Ltd.

(57) ABSTRACT

A motor, comprising: an internal motor chamber, and a rotor rotatable therein. The rotor is drivable by having a pressure medium applied to it and a braking element for braking the rotor. The braking element is axially arranged directly adjacent to the rotor, wherein the braking element and the rotor are axially moveable with respect to each other and form a spring-loaded friction pair, at least between a front end face of the rotor and the braking element.

14 Claims, 9 Drawing Sheets

FLUID MOTOR HAVING IMPROVED BRAKING EFFECT

CROSS REFERENCE TO RELATED APPLICATIONS

This application is a National Stage application of co-pending PCT application PCT/EP2007/011186 filed Dec. 19, 2007, which claims the benefit of German application number 10 2006 061 854.8 filed Dec. 21, 2006. These applications are incorporated herein by reference in their entireties.

FIELD OF THE INVENTION

The invention relates to a motor drivable by a fluid pressure medium. In particular, the invention relates to a motor, wherein a rotor arranged in a motor chamber is drivable by a pressure medium and wherein an axially moveable, spring-loaded braking element forms a friction pair with the end face of the rotor to brake it.

BACKGROUND

Fluid motors are preferably driven with pressurized air or with hydraulic liquid. The work done by the pressure medium during its expansion is used for driving.

A well-known type of motor is the vane motor. It comprises a rotor rotating in a motor chamber with radial vanes. When the rotor is rotated the spaces largely sealed by the vanes and the side wall of the motor chamber change in volume. The pressure medium introduced into these spaces expands and thus drives the rotor.

Such motors have proved very reliable for a great variety of applications, such as for use in hoisting apparatus. For many applications, a braking unit is necessary for braking and holding fast the vane rotor when no pressure medium is supplied. In particular in use in hoisting apparatus, the load is thereby prevented from falling down.

While the braking unit may be coupled to the motor via a shaft in a great variety of well-known hoisting apparatus, it is a separate part external to the motor chamber, i.e., outside of the chamber in which the pressure medium expands.

EP 1 099 040 discloses a vane motor driven by pressurized air. A vane rotor is excentrically rotatably supported in a cylindrical motor sleeve. The motor is driven by introducing pressurized air which expands as the chambers formed between the vanes get larger. A separate braking unit is provided at a shaft of the motor. To lubricate the motor, the vane rotor has longitudinal bores filled with a lubricating agent having a pasty consistency.

DE 1 102 488 discloses a vane motor for hoisting apparatus having a drive shaft which is fixedly braked by a friction brake when the pressurized air is switched off or fails. For this purpose, there is a braking disc on a motor shaft end, which has a centrally arranged pressure cylinder and is pressed against a wear ring of the motor housing by means of a spring load. The pressurized air introduced via an inlet is supplied to a pressure cylinder of the brake disc, causing it to lift off from the wear ring against the resistance of the springs and thus enables the operation of the motor.

WO 95/02762 shows a hydraulic motor. A rotor rotates in a motor chamber. The rotor is axially moveable and is pressed by springs with a conical section against a friction surface fixed with respect to the housing. The motor chamber is in communication with the conical friction pair via channels having valves arranged therein. In operation, the pressure medium passes from the motor chamber to the friction pair and causes axial displacement of the rotor which leads to the friction pair being separated and thus to the brake being released.

WO 97/02406 of the applicant shows a vane rotor with an integrated braking unit. A vane rotor is drivable in a motor chamber by means of pressurized air. A braking element is displaceable and loaded by springs and arranged axially directly adjacent to the vane rotor. The vane rotor thus forms a friction pair at its end face together with the braking element. The friction pair is arranged in the motor chamber, so that in operation the compressed air present therein acts on the braking element and displaces it against the spring load in such a way that the brake is released. This construction has been well-proven in practice. In particular, it results in a compact structure.

It is the object of the present invention to propose a motor in which the braking action is yet improved in a simple manner in comparison to prior-art constructions.

The object is achieved by a motor according to claim 1. Dependent claims refer to advantageous embodiments of the invention.

SUMMARY

The motor according to the present invention has an internal motor chamber and a rotor rotatable therein. The latter is drivable by means of a pressure medium. While the term motor chamber first of all refers to the entire internal area of the motor closed off to the outside, the part (or section of the axial length of the motor chamber) in which the pressure medium expands or decompresses (for hydraulic pressure media the term "decompressed" is more exact, the term "expansion" will be always used in the following, however, for ease of expression) to thus drive the rotor, here is referred to as a working area. The internal motor chamber is preferably cylindrical, i.e., it has—at least partially—a uniform cross-section along its longitudinal axis, preferably (but not necessarily) a circular cross-section. The rotor is preferably a vane rotor; the principle can also be used, however, for other types of fluid expansion motors with other types of rotors.

A braking element is axially arranged adjacent to the rotor for braking the rotor. The braking element and the rotor are axially moveable with respect to each other, i.e., either the rotor is moveable toward a (fixed) braking element, or a braking element is moveable with respect to an axially fixed rotor, or both elements are axially moveable. One or both of the elements have springs for pressing the elements together so that they form a spring-loaded friction pair. Since the braking element is not rotatable about the axis, the friction pair causes braking, which can stop the rotor if the friction is sufficient.

The friction pair is preferably formed on one or both front end faces of the rotor. They need not be radially arranged surfaces, but can have various shapes, such as a double-sided cone.

The ideas leading to the invention comprise the insight that the braking action is dependent on the frictional force and therefore on the coefficient of friction of the materials at the friction pair and the spring force exerted. Herein it is particularly preferred to increase the spring force because it can be excellently adjusted. Increasing the spring force is only possible within limits, however, which are defined by the fact that the pressure medium must still be able to release the brake in the operation of the motor. The pressure of the medium on the one hand and the effective surface on the other hand are the defining parameters for the maximum force available. To achieve a higher force while the pressure remains the same, it is suggested that the surface be increased.

According to the present invention, a special pressure chamber is therefore provided. The pressure chamber is configured so that its extension in the cross-section is larger than the cross-sectional extension of the motor chamber at its working area, i.e., it is at least partially arranged further to the outside with respect to the longitudinal axis. What is to be compared here is on the one hand the cross-section of the motor chamber at the place where the pressure medium drives the rotor by means of expansion (working area), particularly preferably at least in its axially central area, and on the other hand the external extension of the pressure chamber, also seen in cross-section. For the—preferred—case of a circular cylindrical motor chamber, this means that the inner diameter of the boundary of the motor chamber must be regarded as the cross-sectional extension. The pressure chamber is preferably formed as an annular space, wherein its outer diameter is larger than the diameter of the motor chamber. The pressure chamber is therefore radially outside of the working area of the motor chamber so that a substantially increased surface is provided.

The pressure chamber is limited at least from one side by at least one of the elements of the friction pair (braking element/rotor). A pressure built-up in the pressure chamber acts on this element or these elements and results in a force on the braking element and/or the rotor. The pressure chamber is arranged in such a way that the force exerted causes the separation of the friction pair and is therefore directed against the spring force. Thus, by building up a pressure within the pressure chamber, a separation of the friction pair between the braking element and the rotor can be achieved so that the braking action on the rotor is released.

The pressure chamber is arranged according to the present invention so that in the operation of the motor the pressure medium is let into the pressure chamber. Thus, if a pressure medium is supplied to drive the rotor, it also passes into the pressure chamber and causes separation of the friction pair and therefore the release of the brake. The pressure medium can thus pass from a suitable supply line directly into the pressure chamber. It is also possible for the pressure medium to pass from the working area of the motor chamber to the pressure chamber via a connection.

The pressure chamber created according to the present invention can operate in an auxiliary fashion in addition to a pressure chamber already present directly at the friction pair (i.e., between the braking element and the adjacent end face of the rotor). However, if sufficiently dimensioned, it alone can create sufficient force to release the brake.

The motor according to the present invention achieves a design which on the one hand generates great braking forces and on the other hand achieves automatic release of a frictional brake by the pressure medium supplied to the motor in operation. By the large extension of the pressure chamber in cross-section an additional, relatively large, surface is available for the pressure medium to be effective. Thus, even if great braking power is necessary, the advantage of the structure according to WO 97/02406 need not be dispensed with, which automatically releases the brake as the pressure medium is applied to the rotor. Despite this, the structure does not become excessively bulky by the addition of the pressure chamber. No additional moveable parts are necessary, and the axial length of the structure overall can even remain the same. The creation of a compact, cheap motor is possible with the advantages described.

According to a preferred embodiment of the invention, a connection of the pressure chamber is provided in such a way that the function of the pressure chamber is also ensured in a reversible motor when operated in both operating directions. Generally, the motor has a fluid port, via which the pressure medium is supplied, and an exhaust, via which the expanded medium is exhausted. In a reversible motor (i.e., a motor operable in two senses of rotation) two different fluid ports are provided (if the motor is used in a hoist, these are referred to as "lifting side" and "lowering side"), wherein the pressure medium is supplied to either the one or the other fluid port depending on the sense of rotation desired.

To ensure pressurizing of the pressure chamber to properly release the brake in operation and venting of the pressure chamber for applying the brake when the operation is interrupted, the pressure chamber can be connected with the fluid ports (or the fluid port, if the motor only has a single one) in various ways:

On the one hand, a fluid connection of the pressure chamber with a fluid port is possible preferably via a direct, valve-less supply line. Such a valve-less connection should only be established with one of the two fluid ports to avoid shorting.

The motor can be configured in such a way that it is not symmetrically structured with respect to the two fluid ports so that in operation it supplies higher power at a first fluid port (in hoists, this would be the lifting side) than at the second fluid port (lowering side). A connection of the pressure chamber is possible with both the lifting and lowering sides. A connection with the lowering side is preferred here.

One of the fluid ports can be connected with a fluid supply via a throttling element to limit the volume flow. For this purpose, the pressure chamber can be connected with the corresponding supply line downstream of the throttling element. To reduce after-running of the motor, however, it is advantageous if the pressure chamber is connected with the fluid supply upstream of the throttling element, so that any backup at the throttling element does not lead to delayed venting of the pressure chamber and thus to after-running of the motor.

As another alternative, the pressure chamber can be connected to both fluid ports, wherein to avoid shorting at least one valve is provided in the connection. Preferably, a shuttle valve is used, so that during pressurizing the pressure chamber is always in communication with the port having the highest pressure, and during venting, it is always in communication with one of the ports, so that if both ports are vented by the control valve immediate venting is ensured.

According to a further embodiment, the pressure chamber is connected to the working area of the motor chamber. There is an overpressure in operation in both directions. The connection here is preferably a direct, valve-free connection, e.g., a branch channel, a conduit or a selective leak of a joint. Due to the combination of the pressure chamber with the working area of the motor chamber (instead of the connection to the fluid ports) the function of the brake is maintained even in a reversible motor, without any additional overhead.

It is preferred if the pressure chamber is connected to the motor chamber via a line having only one opening to the motor chamber. It is thus ensured, even without valves, that there is no shorting (i.e., the pressure medium flows from the inlet directly via the pressure chamber to the outlet without driving the motor).

If a conduit for feeding the pressure medium from the motor chamber to the pressure chamber is provided, it is preferred if it is connected to a connecting opening arranged on the end face of the rotor. Particularly preferably, this opening is formed in the braking element. As described, the line can preferably be a direct, valve-free line. For the arrangement of the connecting opening it is preferred if it is arranged in the same quadrant—as seen in the axial direction—of the motor chamber as a (first) fluid port. Particularly preferably, the opening is in the area of +/−30° from the fluid port (always measured at the center of the fluid port and the opening). It has been shown that even with reversible motors with two fluid ports, an arrangement of the connecting opening near one of the fluid ports is sufficient for smooth operation in the two operating directions. If the motor has a preferred direction (in hoists, usually the lifting side) it is useful if the connecting opening is arranged in the area near one of the corresponding preferred fluid ports. In the case of loaded hoists, there is a compression toward the fluid outlet during lowering of a load, which helps to provide the pressure necessary to release the brake. In a motor without a preferred direction, it has proven useful if the connecting opening is centrally arranged, i.e., has the same distance to the fluid ports for both senses of rotation.

As a further advantage of the arrangement of the connecting opening at the end face adjacent to the rotor, good starting behavior has been found. The minimal temporal delay occurring due to the effect of the pressure medium first acting on the surface of the braking element present at the working area of the motor, and only thereafter in the pressure chamber due to the motor starting, facilitates a gradual, smooth control of the motor.

According to a further embodiment, the fit of the braking element with respect to a side wall of the motor chamber is such that the pressure medium passes between the two into the pressure chamber. A gap or a leak can be intentionally left here to connect the pressure chamber and the working area of the motor chamber. In this way a connection can be established in a simple manner—without having to provide special channels. The necessary cross-section is small anyway since there is no constant flow through the connection in operation, but the pressure in the pressure chamber is statically maintained.

According to a further embodiment of the invention, the pressure chamber is formed between the braking element (or an element connected to it in view of its axial movement) on the one hand, and the housing (or an element fixed at the housing) on the other hand. In this way, the application of the pressure medium causes the braking element to be displaced in relation to the housing.

Preferably, the pressure chamber is formed as an annular space. An annular space of a relatively large diameter has the advantage that the force effect is uniform and thus the risk of jamming the element, which is displaced within it, is only slight. Since the size of the steps in diameter of the stepped piston can be freely chosen, braking moments of the required strength can be realized depending on the motor power achievable.

According to a further embodiment of the invention, it is suggested that a side wall be provided which surrounds at least the working area of the motor chamber and the braking element. This side wall has at least one step in its longitudinal section. In the preferred case of a cylindrical working area, the side wall preferably comprises two adjacent cylindrical sections with different diameters, which are connected by the step. The braking element accommodated in the area surrounded by the side wall also has a corresponding step. The pressure chamber is then arranged between radially arranged surfaces of the steps. In this way, a pressure chamber can be created in a structurally simple manner, in which the application of pressure leads to an axial displacement of the braking element.

BRIEF DESCRIPTION OF THE DRAWINGS

Exemplary embodiments will described in the following in more detail with reference to the accompanying drawings, wherein.

DETAILED DESCRIPTION

Figure 1:
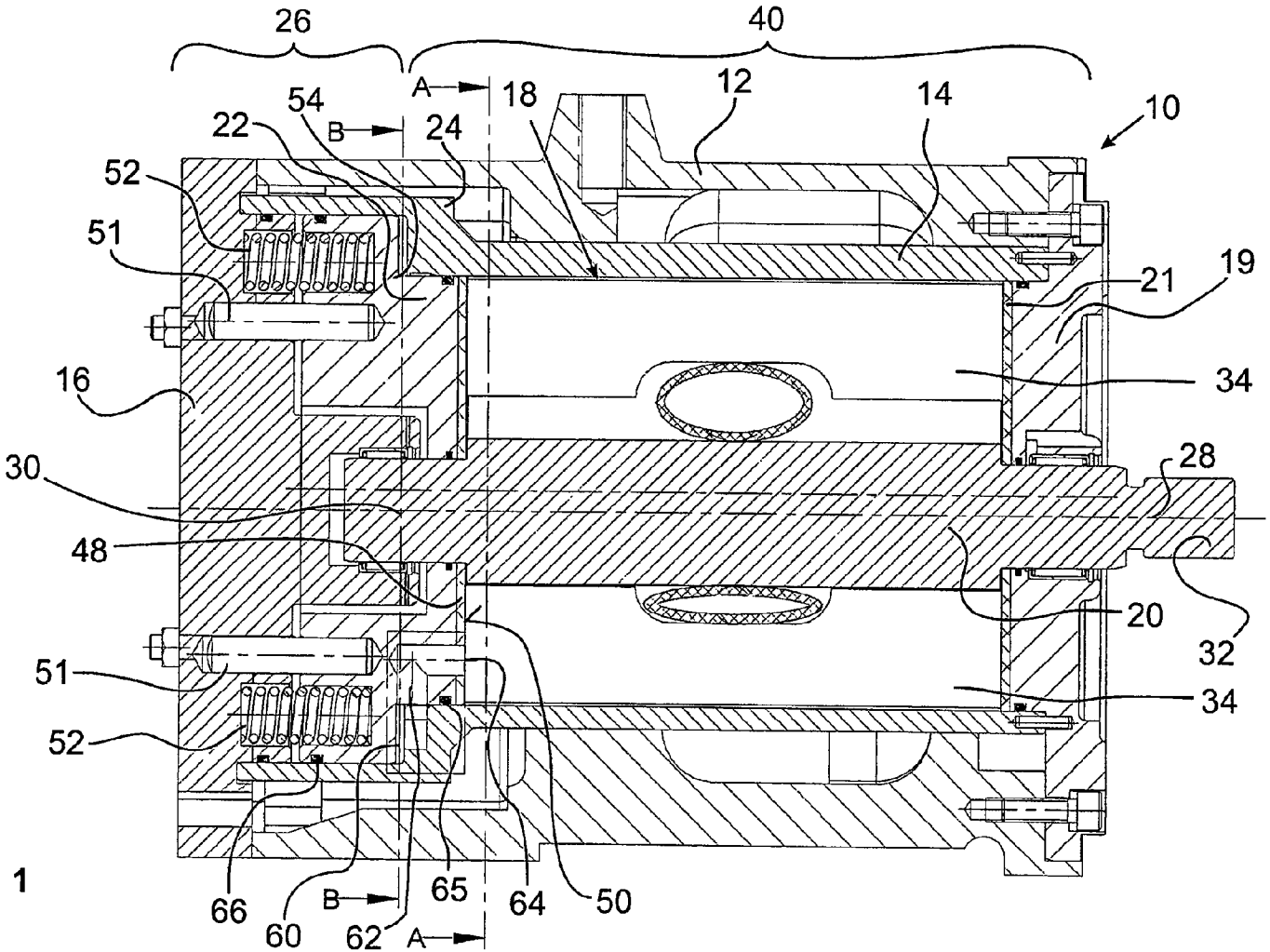
FIG. 1 is a longitudinal sectional view of a first embodiment of a vane motor.

FIG. 1 shows a motor (vane motor) 10 according to a first embodiment in a longitudinal sectional view. A housing 12 comprises a motor sleeve 14 and an end-face cover 16 and a further end-face cover 19 with a brake lining 21.

Motor sleeve 14 is the boundary of an inner motor chamber 18. In an alternative embodiment (not shown), a separate motor sleeve can be dispensed with, and inner motor chamber 18 can be formed by the housing side wall. A vane rotor 20 and a braking element 22 are arranged in internal motor chamber 18.

Motor sleeve 14 comprises a first step 24 formed between two circular cylindrical sections of different diameters. A first section 26 has a larger inner diameter than a second section adjacent to the former.

Vane rotor 20 is arranged in the area of the second section with the smaller inner diameter. As a person skilled in the art of vane motors knows, vane rotor 20 is excentrically arranged within this area. As shown in FIG. 1, rotary axis 28 having a bearing stud 30 on the one end and a driving stud 32 on the other end is displaced to the bottom with respect to the longitudinal central axis of motor sleeve 14. This can also be seen in the cross-sectional view shown in FIG. 2.

Figure 2:
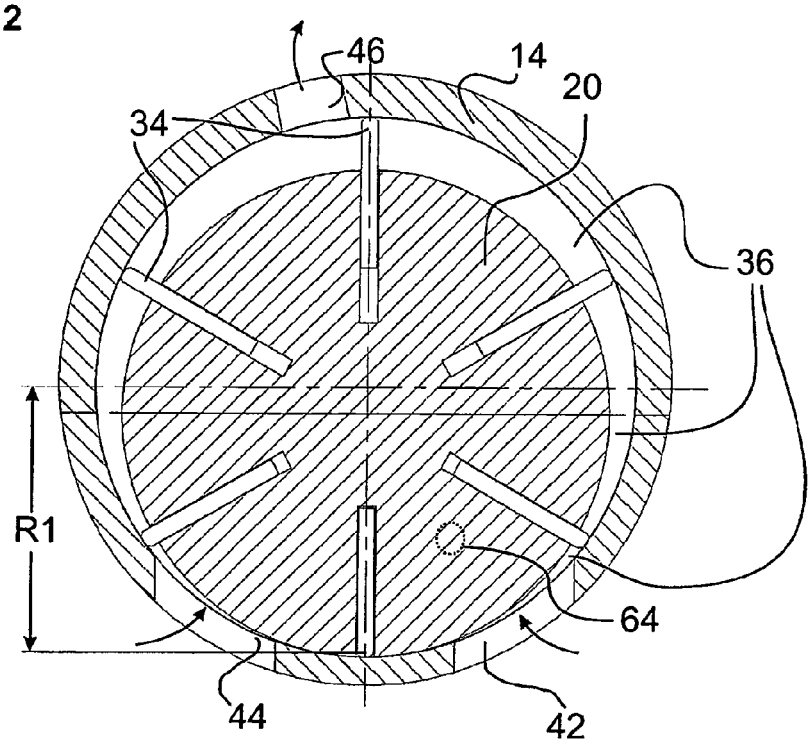
FIG. 2 is a cross-sectional view of the vane motor of FIG. 1 along line A-A'.

As can also be seen from FIG. 2, vane rotor 20 has a number of radially slidable, outwardly spring-loaded vanes 34. The vanes abut on motor sleeve 14 and thus form the boundaries of spaces 36. The vanes are provided over the entire axial length of a working area 40 (cf. FIG. 1) of motor 10.

Motor sleeve 14, at the circumference of working area 40, has a first pressurized-air inlet 42, a second pressurized-air inlet 44 and an exhaust 46. In operation in the preferred direction (rotation to the left in FIG. 2), pressurized air is supplied through pressurized-air inlet 42. As vane rotor 20 rotates, the pressurized air expands in spaces 36 between vanes 34 increasing in size with the rotation, until it is exhausted at exhaust 46 under a residual pressure.

In operation in the opposite sense of rotation (rotation to the right in FIG. 2) pressurized air is supplied through pressurized-air inlet 44. As can be seen in FIG. 2, exhaust 46 is not symmetrically arranged between pressurized-air inlets 42, 44, but has a greater distance to first pressurized-air inlet 42. As a consequence, the first sense of rotation driven by this first pressurized-air inlet 42 is the preferred direction (e.g., in a hoist, the lifting direction), in which the power output of motor 10 is higher than in the opposite direction.

As shown in FIG. 1, braking element 22 is arranged axially directly adjacent to vane rotor 20. Together with a brake lining 48 mounted on the surface it forms a friction pair with end face 50 of vane rotor 20. Spring elements 52, of which only two are shown in FIG. 1, act on braking element 22 and apply a force to it in the axial direction for pressing the elements of friction pair 48, 50 together. The braking element is held by studs 51 so that it is able to move axially, but is non-rotatable with respect to housing 12. A further friction pair is formed between axially moveable vane rotor 20 and cover 19 provided with a brake lining 21 so that vane rotor 20 is braked on both sides.

Figure 3:
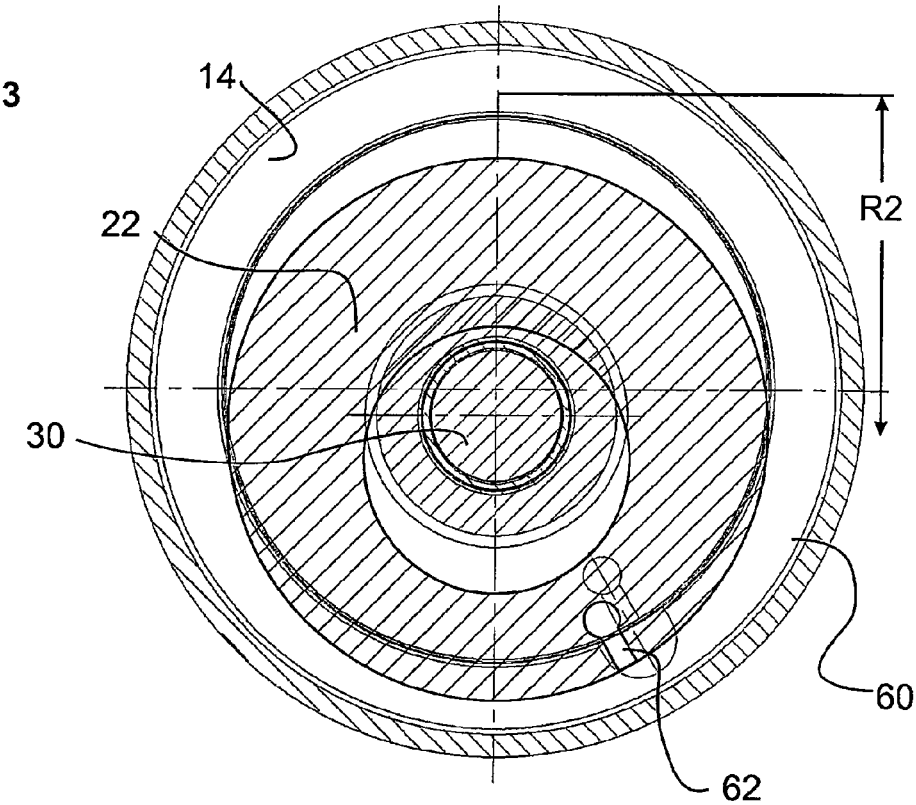
FIG. 3 is a cross-sectional view of the vane motor of FIG. 1 along line B-B' and FIGS. 4*a*, 4*b* are diagrams showing the principle of releasing the brake in a vane motor comparable to the one shown in FIG. 1.

Following step 24 provided in motor sleeve 14, brake element 22 accommodated within motor sleeve 14 is also provided with a step 54. A pressure chamber 60 is formed between the axial surfaces of the stepped portion of brake element 22 and step 24 of motor sleeve 14. Pressure chamber 60 has the form of a circumferential annular space, as can be seen in FIG. 3. As seen by comparing FIGS. 2 and 3, pressure chamber 60 has a larger extension in the direction transverse to the longitudinal center axis of motor sleeve 14 than working area 40 of motor 10. Pressure chamber 60 extends up to a radius R2 (FIG. 3) while motor sleeve 14 in working area 40 only has a smaller inner diameter R1 (FIG. 2).

In the first embodiment, pressure chamber 60 is connected via a line 62 formed as a channel within braking element 22. It connects pressure chamber 60 with an opening 64 in the surface facing vane rotor 20, of braking element 22. Line 62 is formed as a direct, valve-free connection of only one opening 64 with pressure chamber 60.

Figure 5:
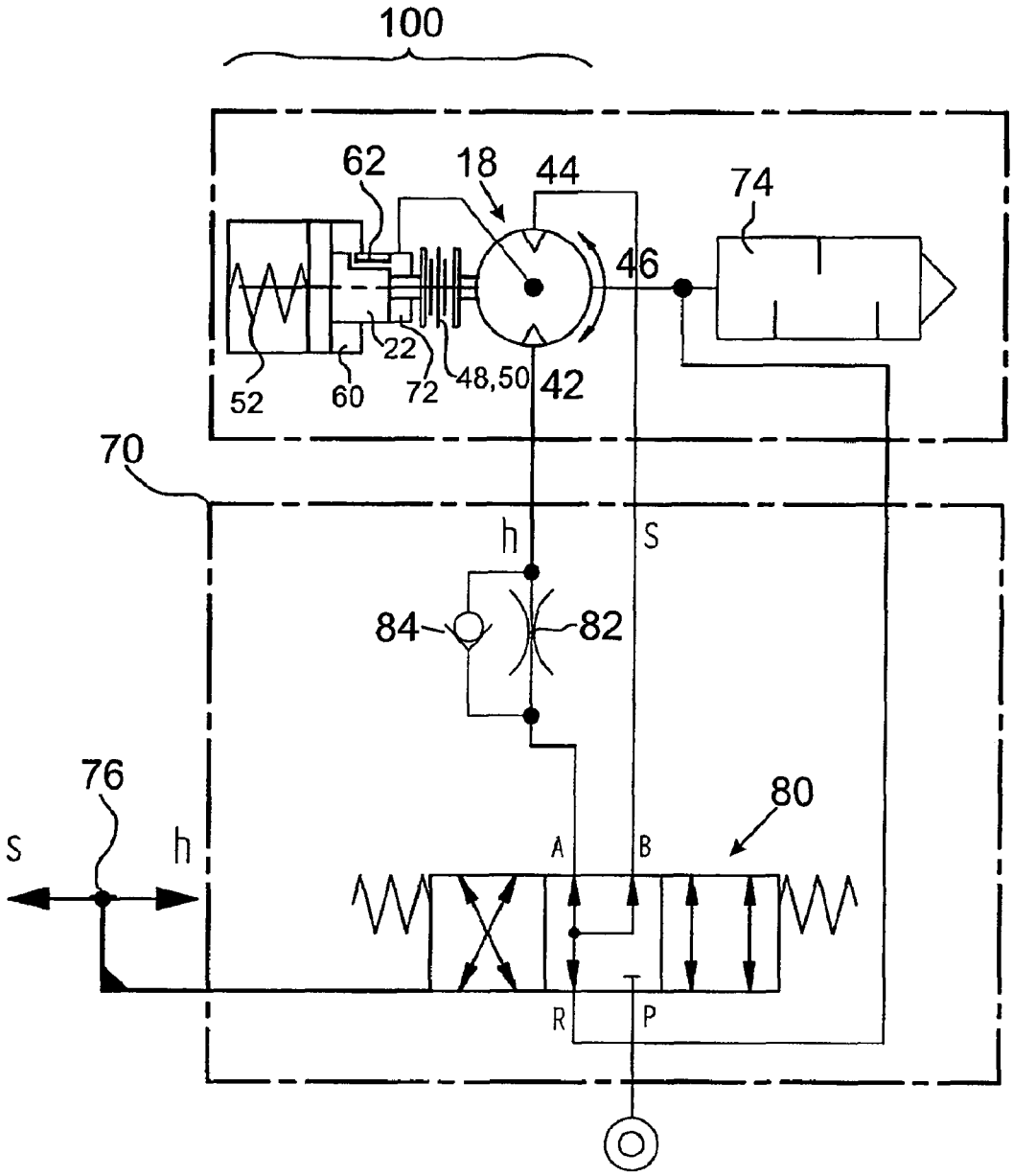
FIG. 5 is a schematic diagram as a pneumatic circuit diagram of the motor of FIG. 1 with a control.

FIG. 5 shows in schematic form motor 10 with its pneumatic connections. The connections are only shown in a form reduced to the essential parts for clarity; further control functions such as emergency stop and an overload shutdown for a hoist are therefore not shown here.

The internal motor chamber 18 is connected to the lifting side h of a control valve 70 via its first pressurized-air inlet 42 and to the lowering side s with its second pressurized-air inlet 44. Vane rotor 20 is braked by the friction pair, symbolically shown here, between brake lining 48 and end face 50. The brake is released by a supply of pressurized air to a space 72 between braking element 22 and end face 50, shown in FIG. 4*b* and explained below, and—via channel 62—to pressure chamber 60, wherein the pressure built-up in the two pressure chambers 60, 72 presses brake element 22 against spring 52. Exhaust 46 of the motor is coupled to a muffler 74.

Control valve 70, in the example shown, has an operating lever 76 displaceable from a central idling position to the lowering s mode or to the opposite lifting h mode, wherein in a slide gate valve 80 by displacement in relation to the ports, various valve functions are realized between pressurized-air supply P and a vent port R (connected to muffler 74) on the one hand and a supply port A for the lifting side and B for the lowering side on the other hand:

In the idling position shown, ports A and B are vented, i.e., connected with R. In the lifting mode (left valve function in FIG. 5), the pressurized-air port of lifting side A is connected with pressurized-air supply P, while the lowering side is vented (connection B-R due to crossed position of valve 80). Supply port A is connected with the valve outlet of lifting side h by means of the parallel connection of a throttling element 82 with a check valve 84, wherein check valve 84 acts in such a way that in the lifting operation the pressurized air can flow to lifting side h via check valve 84 so that throttle 82 does not limit the fluid flow, but acts as an additional connection besides valve 84.

In the lowering mode (right valve function in FIG. 5) lowering side s is directly connected with pressurized-air supply P, while lifting side h is vented via throttling element 82 (connection A-R, where check valve 84 is blocked). The throttling element thereby limits the volume flow of the pressure medium. It can be easily realized as a bottle-neck in the conduit path, for example as a pinhole plate. In the lowering mode, throttling element 82 serves to limit the lowering speed. This is because, in this mode, on the one hand pressurized air is supplied to the motor via pressurized-air port 44, which expands until it reaches exhaust 46. On the other hand, however, the motor acts as a compressor due to a load to be lowered on the hoist, which compresses the air from exhaust 46 to pressurized-air port 42 (lifting side) with the aid of the reduced volume of the vane spaces 36. This compressed air is fed to the control valve and to port h, and vented via throttling element 82. A braking action is created due to the backup by limiting the volume flow at throttling element 82, which results in the load being gently lowered.

Figure 4A:
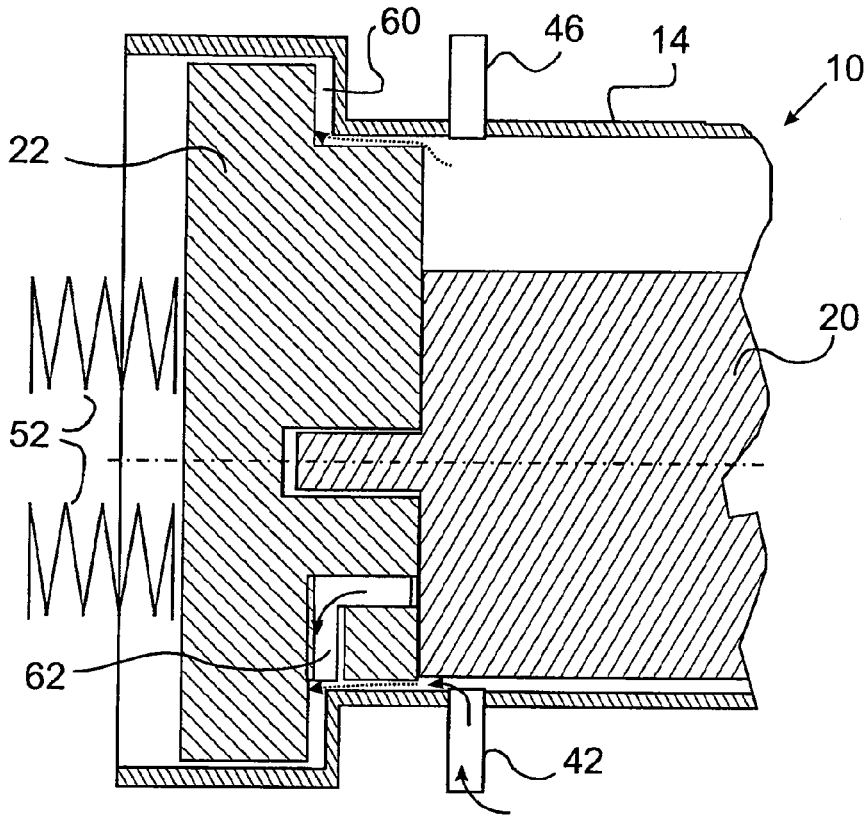
Figure 4B:
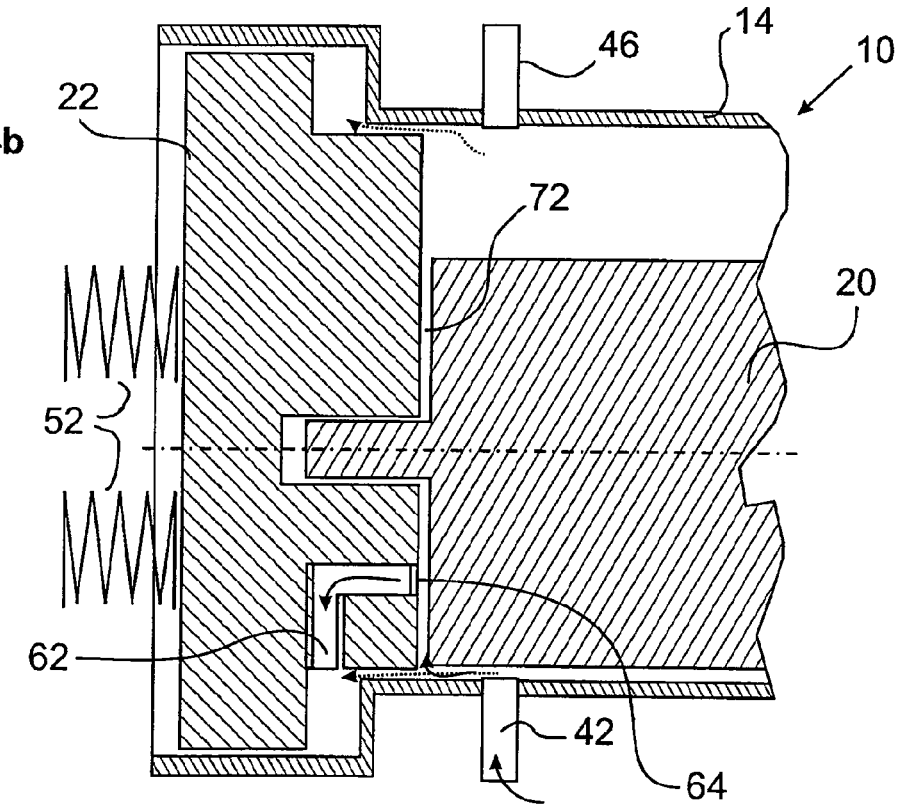

In the operation of motor 10, the brake is automatically released as pressurized air is applied to one of the two pressurized-air inlets 42, 44, while rotor 20 is automatically held fast between brake lining 48 of braking element 22 and brake lining 21 of fixed cover 19 as the pressurized-air supply lessens. This mechanism is illustrated in the following with reference to the schematic diagrams in FIGS. 4*a* and 4*b*. It should be noted that the illustration in FIGS. 4*a* and 4*b* is purely schematic and has the purpose of explaining the general functioning principle. For this reason, some details have been omitted, and particularly the gap widths are exaggerated.

FIG. 4*a* shows the braked motor 10. Vane rotor 20 is braked by the application of braking element 22. Motor 10 is thus stopped by the force of spring elements 52.

To start the motor, pressurized air is now supplied via pressurized-air inlet 42. As shown in FIG. 2, the pressurized air passes into a vane space 36. Since vane rotor 20 is stopped, there is at first no rotation of vane rotor 20. The pressure acts in space 36 instead (and through leaks on the vanes soon also on the entire surface) on the axially displaceable braking element 22, so that the latter begins to detach itself from vane rotor 20 against the force of spring elements 52 so that a pressure chamber 72 is formed (cf. FIG. 4*b*).

However, spring elements 52 exert such an extreme force on braking element 22 that the pressure acting on the surface of friction lining 48 alone would not be sufficient to fully release the brake.

At the same time, however, the pressurized air also passes into pressure chamber 60. This can happen in two different ways. On the one hand, leaks can remain in the fit between motor sleeve 14 and braking element 22, through which the pressure medium passes into pressure chamber 60 (dotted arrows in FIG. 4*a*). In the preferred construction according to FIG. 1, recesses for seals 65 are provided for this purpose. If no seal is inserted here, a sealing is missing at this place and the path shown as dotted arrows in FIG. 4*a* of the pressure medium into pressure chamber 60 is created.

As an alternative or as a complement, the pressure medium also passes through opening 64 in braking element 22 and the line 62 connected thereto into pressure chamber 60. Opening 64 may at first appear closed in the resting position (FIG. 4*a*). But the pressure medium still passes through it in operation, since on the one hand the abutment of vane rotor 20 and braking element 22 is not fully sealing. On the other hand the introduction of the pressure medium already causes a first movement of braking element 22 so that opening 64 is then freed. In a preferred embodiment (not visible in FIG. 1 due to its small dimensions) a slightly elevated ring can be left also during manufacture of vane rotor 22 on the inside of its end 50, which has the effect that opening 64 is not completely closed (not shown) while braking element 22 abuts on it.

The arrangement of opening 64 is clearly visible in a combined view of FIGS. 1 and 2. In a radial direction, it lies inside the surface facing the working area 40 of the motor chamber through the braking element 22, i.e., not directly on the edge, as shown in FIG. 1. The position of opening 64 relative to pressurized-air inlets 42, 44 and exhaust 46 can be seen in FIG. 2. Herein, opening 64 is arranged in the area of pressurized-air inlet 42 of the lifting side. As has been shown in tests, the arrangement in the area of this pressurized-air inlet is particularly advantageous. It is therefore preferred if opening 64 is arranged in the same quadrant of the motor chamber as pressurized-air inlet 42, as shown in FIG. 2. Particularly preferably, the angle between the center of pressurized-air inlet 42 and the center of opening 64 is not larger than 30°.

This arrangement of opening 64 is particularly advantageous for the operation in the lifting direction (pressurized air to pressurized-air inlet 42). As has been shown in tests, there is sufficient pressure build-up even if pressurized air is supplied via pressurized-air inlet 44 in the area of opening 64 when the hoist is loaded, so that pressure chamber 60 is sufficiently rapidly filled, because a higher pressure is generated in the area of opening 64 than at pressurized-air inlet 44 during lowering of the load—due to a pumping action, so to speak.

The pressure medium acts on the radial surfaces of braking element 22, namely on the one hand on the inner surface, involved in the friction pair 48, 50, and on the other hand on the additional annular surface formed by step 54. The force acting overall on braking element 22 corresponds to the product of the pressure of the pressure medium and the surface area. By suitable sealing measures (sealing seat 66 in FIG. 1) pressure medium is prevented from passing behind braking element 22. As a result, it is possible to release braking element 22 solely by the pressure of the pressure medium.

Lifting the braking element 22—and thus starting the motor 10—always occurs gradually, even if the pressure medium is rapidly applied to pressurized-air inlet 42. The reason for this is that initially the braking element 22 is slightly displaced by the pressure on the end face of vane rotor 20 alone and thus the braking action reduced. Also, pressurized air flows into pressure chamber 60 with a (slight) delay so that the braking action can then be completely removed.

In operation braking element 22 remains at a distance to vane rotor 20 as long as the pressure medium is supplied. After switching off the pressure medium, the brake automatically kicks in due to the force of spring elements 52.

Pressure chamber 60 thus enlarges the surface area on which the pressure of the pressure medium can act on brake element 22. It is thus possible to predetermine a desired, increased braking force by providing suitable, stronger springs 52.

Figure 6:
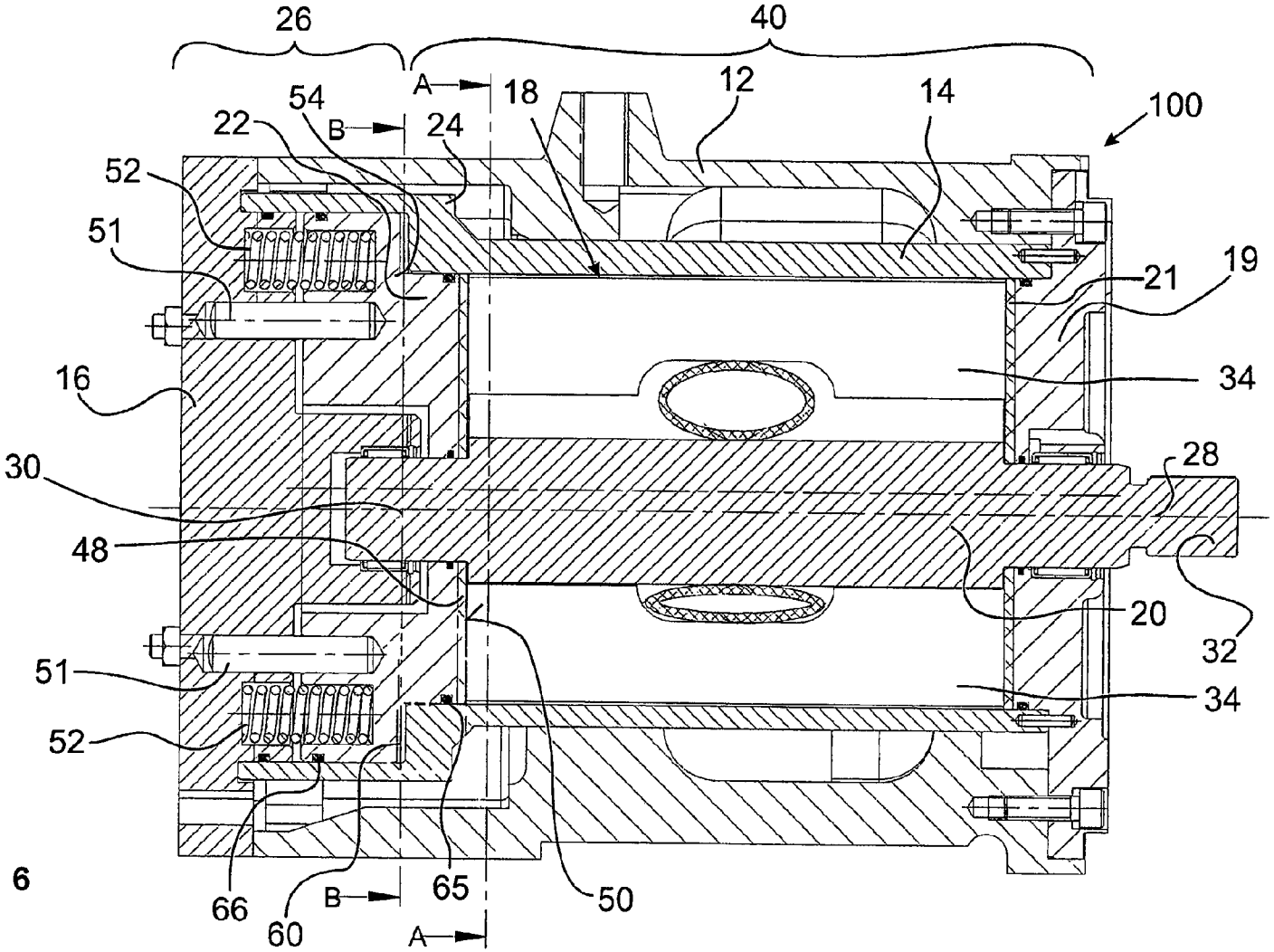
FIG. 6 is a longitudinal sectional view of a second embodiment of a vane motor.

FIG. 6 shows a second embodiment of a vane motor 100 which has proven particularly advantageous in tests. Motor 100 according to the second embodiment largely corresponds to motor 10 according to the first embodiment. It has largely the same elements as motor 10. These elements will therefore be indicated by the same reference numerals. With respect to these elements, reference is made to their description given above. Only differences between the embodiments will be mentioned in the following.

Motor 100, in contrast to motor 10, does not have an opening 64 in the end face of braking element 22, and therefore also no channel 62, which connects internal motor chamber 18 with pressure chamber 60. Instead, pressure chamber 60 is closed with respect to internal motor chamber 18 by the fit of the components and in particular by seals 65.

In motor 100, pressure chamber 60 is pressurized and vented by an external supply line (not shown in FIG. 6). This supply line can be connected in various ways, as shown in FIGS. 7 to 10 and explained in the following.

The subject matter of the considerations is the operation of the motor of a hoist in the lowering mode with a corresponding load. Herein it should be ensured that when the lowering operation is interrupted (i.e., slide gate valve 80 is switched from the "lowering" position to the central position) with a load attached, a braking action is carried out immediately, and there is no afterrunning of the motor, if possible. In the present case, in the above-discussed embodiment, in the case of an insufficient connection of pressure chamber 60 with internal chamber 18 of the motor, it may happen that pressure chamber 60 is vented too slowly, and the brake therefore reacts too late. To avoid this in the various connection types according to FIGS. 7 to 10, external pressurizing and venting is provided for pressure chamber 60.

Figure 7:
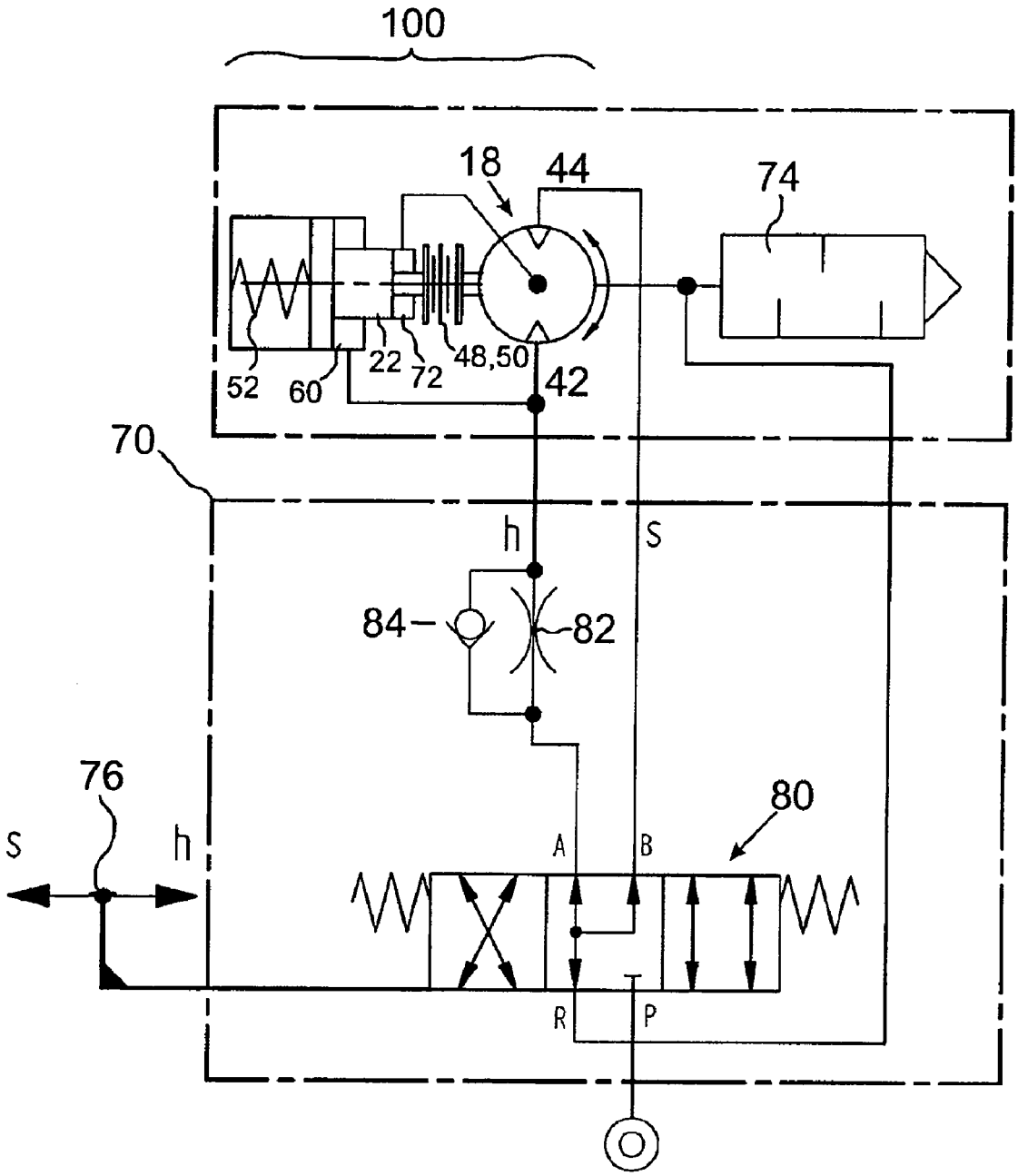
FIGS. 7-10 are schematic diagrams as a pneumatic circuit diagram of the vane motor of FIG. 6 with a control in various types of connection.

In the first connection type according to FIG. 7, pressure chamber 60 is directly connected to the lifting side (pressurized-air port 42). In lifting operation, pressure chamber 60 is pressurized from there, and vented when switched back to neutral. In the lowering operation, releasing the brake is at first mainly carried out by pressurizing pressure chamber 72 and then by pressurizing pressure chamber 60 due to the backup arising upstream of throttling element 82. When the lowering mode is interrupted, slide gate valve 80 is displaced into its central position, and thus a vent is created upstream of the lifting and lowering side. Venting of pressure chamber 60 occurs via the lifting side as soon as the backup upstream of throttling element 82 has subsided.

Figure 8:
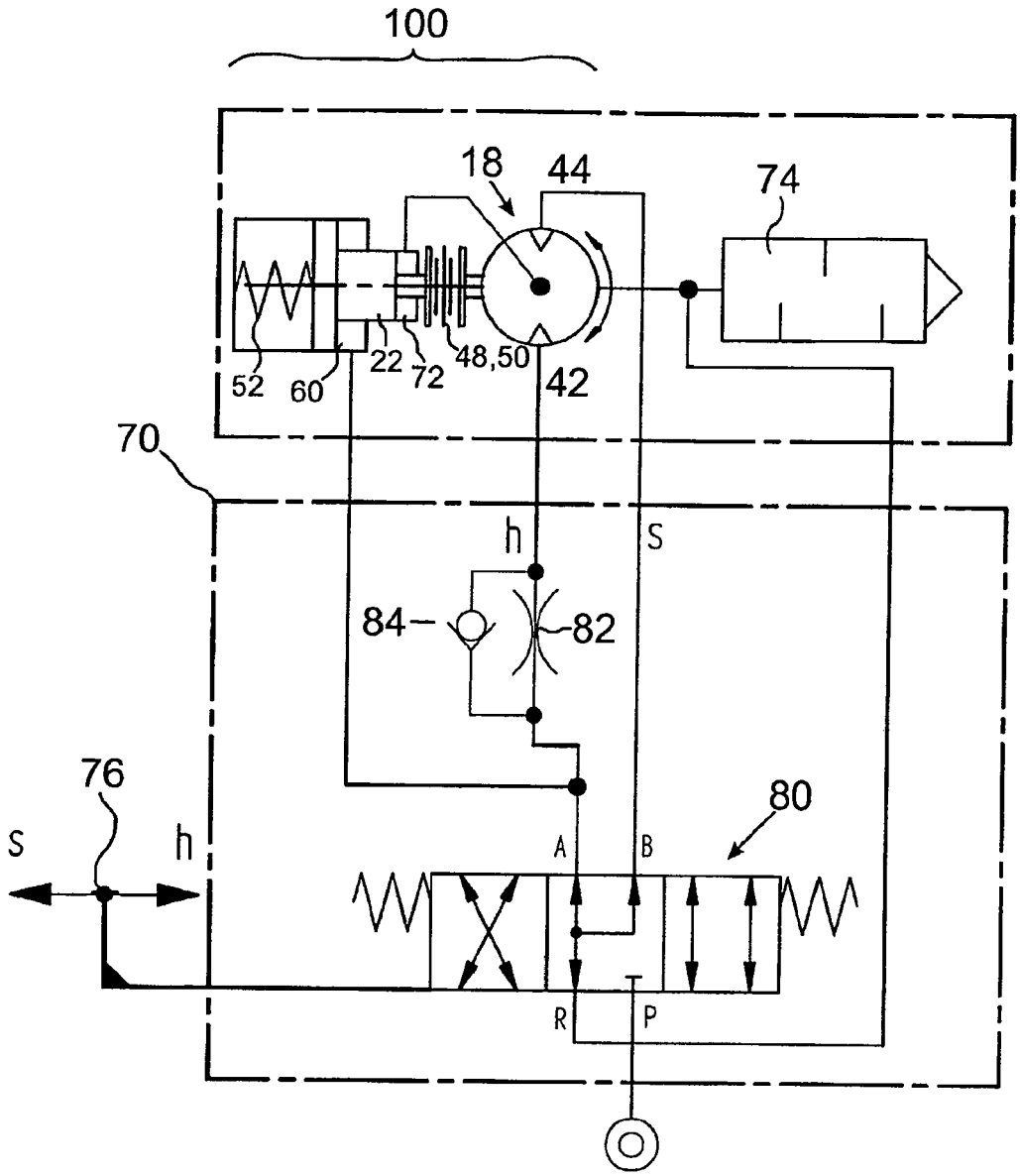

For applications in which the backup upstream of throttling element 82 proves to be too great, such that the motor exhibits afterrunning behavior after the lowering mode has been interrupted, pressure chamber 60 can also be connected upstream of throttling element 82, as alternatively shown in FIG. 8, so that venting occurs immediately as slide gate valve 80 is switched.

Figure 9:
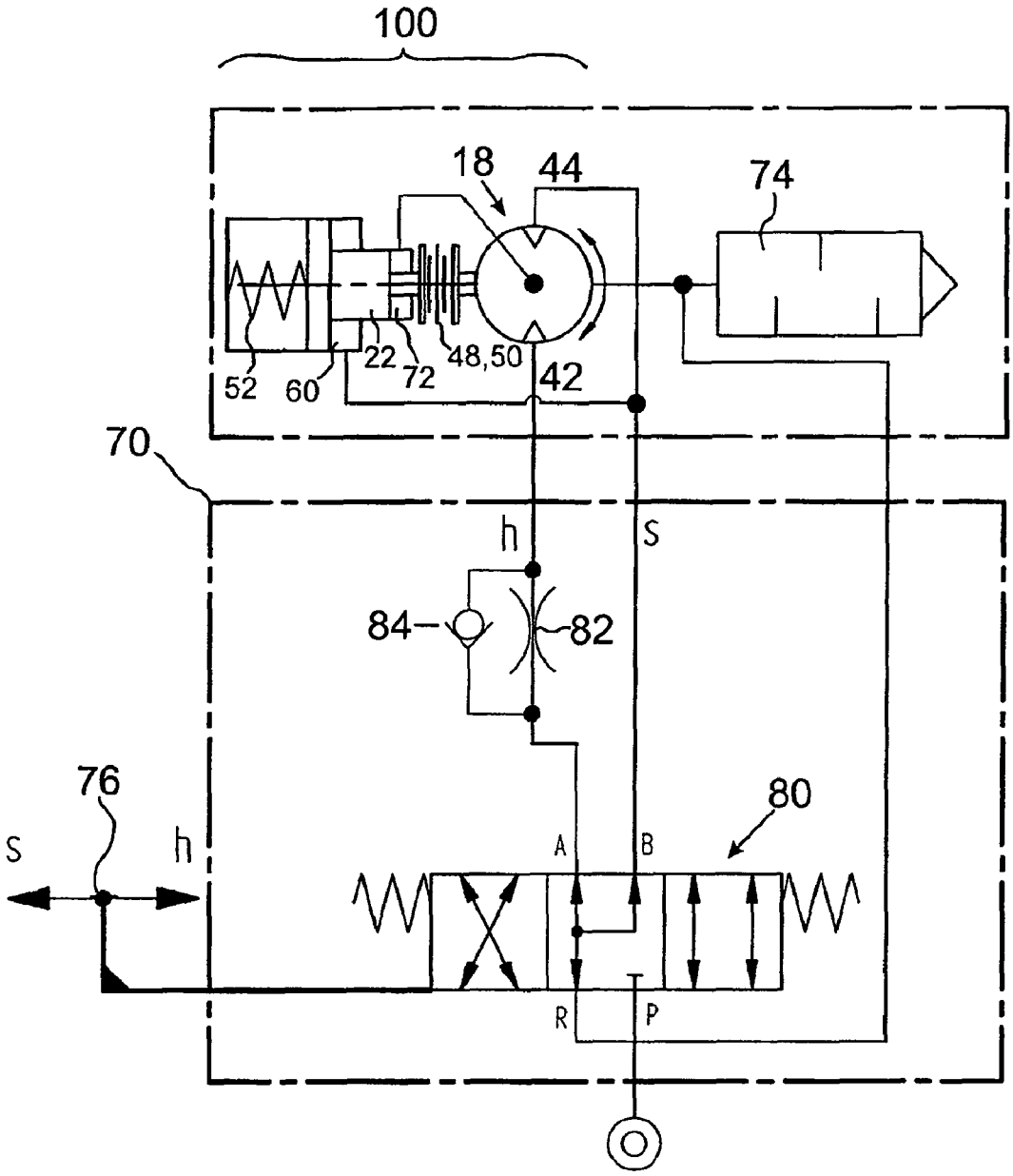

Alternatively, and presently preferred, pressure chamber 60 is connected to the lowering side (as shown in FIG. 9). In the lifting mode, venting is then carried out via the lowering side as soon as the brake has been slightly released by a pressure build-up in pressure chamber 72. In the lowering mode, direct venting occurs at an interruption and as slide gate valve 80 is switched to the central position, since there is no throttling element on the lowering side, but in the middle position the lowering side is directly vented to exhaust 46.

Figure 10:
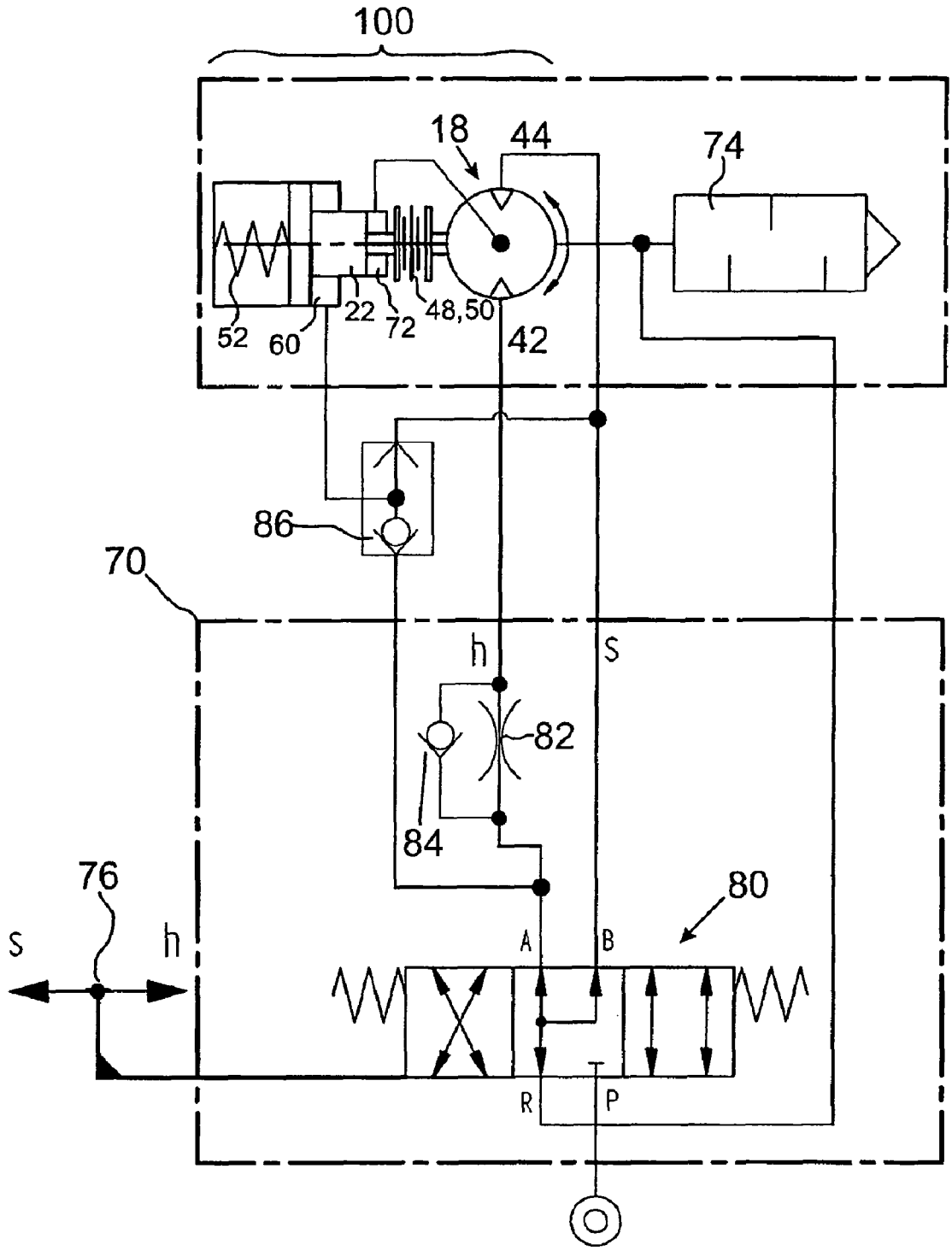

As a further possible type of connection, FIG. 10 shows the connection of pressure chamber 60 both to the lifting and lowering sides. To prevent shorting, a shuttle valve 86 is provided. In the lifting mode, pressure chamber 60 is vented immediately from the lifting side, wherein valve 86 prevents a short to the lowering side. In the lowering mode, however, venting is carried out directly from the lowering side, wherein valve 86, again, prevents a direct short to the lifting side. Upon interruption of the lowering operation, venting of pressure chamber 60 is carried out via the lifting or lowering side, both of which are directly vented in the central position of slide gate valve 80.

As will be obvious to one skilled in the art, the present invention is not limited to the embodiments shown and described. In particular, the following modification are conceivable:

- In the construction of a motor according to FIG. 1, a stepped, integral motor sleeve 14 is provided. Alternatively, the housing of the motor can also have a different structure to create an internal motor chamber.
- While a vane motor driven by pressurized air has been described above, the inventive principle can also be applied to other motor types (e.g., gear motor) and other driving media (e.g., hydraulic liquid), as will be obvious to a person skilled in the art.

While it is described above that pressure chamber 60 is connected in each case alternatively via channel 62 or via an external supply line, the two types of connection can also be combined.

The lever control schematically shown in FIGS. 5 and 7 to 10 can be replaced by other types of control, for example a pressurized-air control, by which the slide gate valve 80 can be displaced into the corresponding switching positions.

What is claimed is:

1. A motor, comprising:

an internal motor chamber (18), and a rotor (20) rotatable therein, wherein the rotor is drivable by having a pressure medium applied to it, wherein the pressure medium expands in a working area (40) of the motor chamber, and a braking element (22) for braking the rotor (20), which is axially arranged directly adjacent to the rotor (20), wherein the braking element (22) and the rotor (20) are axially moveable with respect to each other and form a spring-loaded friction pair (48, 50), at least between a front end face of the rotor (20) and the braking element (22), characterized by a pressure chamber (60) having an extension in cross-section larger than the cross-sectional extension of the motor chamber (18) at its working area (40), wherein the pressure chamber (60) is at least unilaterally, axially delimited by the braking element (22) or the rotor (20), so that a pressure in the pressure chamber (60) results in a force to separate the friction pair (48, 50) against the spring force, and wherein the pressure chamber (60) is arranged in such a way that the pressure medium passes into the pressure chamber (60), when the motor is in operation.

2. The motor according to claim 1, wherein at the motor chamber (18) a first fluid port (42), a second fluid port (44) and an exhaust (46) are provided, which are arranged over the circumference of the working area (40) of the motor chamber at intervals, wherein the motor (10) is drivable by supplying fluid to the first fluid port (42) in a first sense of rotation and by supplying fluid to the second fluid port (44) in a second sense of rotation, wherein the pressure chamber (60) is connected with the first fluid port (42) or the second fluid port (44) in such a way that in the operation of the motor (10) the pressure medium passes into the pressure chamber (60).

3. The motor according to claim 2, wherein the connection of the pressure chamber (60) with either the first or the second fluid port (42, 44) is a valve-free supply line.

4. The motor according to claim 2, wherein a supply line (A) is connected with one of the fluid ports (42) via a throttling element (82) to limit the volume flow of the pressure medium, and the pressure chamber (60) is connected to the supply line (A) upstream of the throttling element (82).

5. The motor according to claim 2, wherein the pressure chamber (60) is connected with the two fluid ports (42, 44), wherein at least one valve (86) is provided in the connection to avoid shorting.

6. The motor according to claim 1, wherein at the motor chamber (18) a first fluid port (42), a second fluid port (44) and an exhaust (46) are provided, which are arranged over the circumference of the working area (40) of the motor chamber at intervals, wherein the motor (10) is drivable by supplying fluid to the first fluid port (42) in a first sense of rotation and by supplying fluid to the second fluid port (44) in a second sense of rotation, wherein the pressure chamber (60) is connected with the working area (40) of the motor chamber (18) via a direct, valve-free connection (62, 64), so that the pressure medium passes into the pressure chamber (60) in the operation in both senses of rotation.

7. The motor according to claim 6, wherein the fit of the braking element (22) with respect to a side wall (14) of the motor chamber (18) is such that the pressure medium passes between the braking element (22) and the side wall (14) into the pressure chamber (60).

8. The motor according to claim 6, wherein at least one line (62) is provided for feeding the pressure medium from the working area (40) into the pressure chamber (60), wherein the line (62) is connected to a connecting opening (64) arranged in the braking element (22) at the end face adjacent to the rotor (20).

9. The motor according to claim 8, wherein the line (62) has only one connecting opening (64).

10. The motor according to claim 8, wherein at the working area (40) at least one first fluid port (42) is provided for supplying the pressure medium to be applied to the rotor (20), wherein the connecting opening (64) is arranged in the same quadrant of the motor chamber (18) as the first fluid port (42) as seen in the axial direction.

11. The motor according to claim 1, wherein the pressure chamber (60) is formed between the braking element (22) and the housing (12, 14).

12. The motor according to claim 1, wherein the pressure chamber (60) is an annular space axially delimited by the braking element (22), wherein the annular space (60) has an outer diameter (R2) greater than the transverse extension (R1) of the working area (40) of the motor chamber.

13. The motor according to claim 1, wherein a side wall (14) is provided surrounding the working area (40) of the motor chamber and the braking element (22), wherein the side wall (14) has at least one step (24) in the longitudinal section, wherein the pressure chamber (60) is formed in the area of the step (24).

14. The motor according to claim 1, wherein the pressure medium being fed to the rotor (20) acts on the braking element (22) being in contact with the front end face of the rotor (20) to provide a force for separation of the friction pair (48, 50) and the pressure in the pressure chamber (60) provides an additional force for separation of the friction pair (48, 50) opposite to the spring force.

* * * * *